US005689897A

United States Patent [19]

Schiel

[11] Patent Number: 5,689,897

[45] Date of Patent: Nov. 25, 1997

[54] STEAM BLAST BOX AND METHOD FOR THE ZONE-WISE TEMPERATURE CONTROL OF A TRAVELING PAPER WEB

[75] Inventor: Christian Schiel, Heidenheim, Germany

[73] Assignee: Voith Sulzer Papiermaschinen GmbH, Germany

[21] Appl. No.: 714,849

[22] Filed: Sep. 17, 1996

[30] Foreign Application Priority Data

Sep. 18, 1995 [DE] Germany ..... 195 34 573.8

[51] Int. Cl.[6] ..... D21F 5/00

[52] U.S. Cl. ..... 34/114; 34/119; 34/122; 34/124

[58] Field of Search ..... 34/114, 117, 119, 34/122, 124, 130, 131, 132, 632, 629, 633, 636, 638; 162/206, 207

[56] References Cited

U.S. PATENT DOCUMENTS

| | | | |
|---|---|---|---|
| 4,330,947 | 5/1982 | Throp | 34/54 |
| 4,351,700 | 9/1982 | Dove | 163/252 |
| 4,580,315 | 4/1986 | Boissevain | 162/207 X |
| 4,662,398 | 5/1987 | Wyuwailowski et al. | 34/114 X |
| 4,671,173 | 6/1987 | Boissevain | 100/38 |
| 4,836,894 | 6/1989 | Chance et al. | 162/206 X |
| 4,867,054 | 9/1989 | Taylor | 100/93 RP |
| 5,477,824 | 12/1995 | Haessner et al. | 34/117 |
| 5,519,935 | 5/1996 | Ahvenniemi et al. | 34/122 |

FOREIGN PATENT DOCUMENTS 0380427 1/1990 European Pat. Off. .

*Primary Examiner*—John M. Sollecito
*Assistant Examiner*—Steve Gravini
*Attorney, Agent, or Firm*—Ostrolenk, Faber, Gerb & Soffen, LLP

[57] ABSTRACT

A steam blast box for applying steam to a web of paper conducted over a roll of a paper machine. The box has a closed steam blast chamber which extends along the roll transverse to the direction of travel of the web and to which steam can be fed. The front wall of the box, which faces the roll, has a plurality of steam outlet openings. A steam propagation space is formed between the front wall of the steam blast box and the roll. For controlling the temperature and/or for regulating the amount of heat transferred to the web of paper in the steam propagation space, an air outlet channel, which extends transverse to the direction of travel of the web and is located at the web inlet end of the steam propagation space, is provided for the admixing of air in the steam. In this way, sensitive separate, zone-wise control of the heating of the paper web can be obtained. The steam propagation space can be cooled zone-wise by feeding air on the inlet side. Air and steam are drawn off at the outlet end of the propagation space, also zone-wise across the web.

15 Claims, 2 Drawing Sheets

STEAM BLAST BOX AND METHOD FOR THE ZONE-WISE TEMPERATURE CONTROL OF A TRAVELING PAPER WEB

BACKGROUND OF THE INVENTION

The present invention relates to a steam blast box for applying steam to a paper web conducted over a roll of a paper machine, and particularly to such a blast box with zone-wise control of the temperature of the web across the web.

The blast box has a closed steam blast chamber which extends along the roll, transverse to the direction of travel of the web. Steam is fed to the chamber. The front wall of the chamber facing the roll has a plurality of steam outlet openings. A steam propagation space is formed between the front wall of the steam blast box and the roll.

In a steam blast box known from Federal Republic of Germany 41 25 062 A1, steam is introduced through a steam valve into a steam blast chamber. From the chamber, steam passes via steam outlet openings into a steam propagation space. This heats the paper web which is guided over a roll as it moves through the steam propagation space.

The known steam blast box has a disadvantage that controlling the temperature on the surface of the web of paper is possible only with difficulty because the steam distributes uniformly within the steam propagation space and is thus absorbed substantially uniformly by the paper web. As soon as the steam has condensed on the paper web in the layer close to the paper, an insulating layer of air forms in front of the paper web, which prevents further heating of the paper web. Heating of the paper web is thus limited.

Zone-wise control of the temperature of the paper web across the web and the roll is hardly possible due to the insulating layer of air.

SUMMARY OF THE INVENTION

The object of the present invention therefore is to provide a steam blast box for applying steam to a web of paper guided over a roll of a paper machine and for enabling more sensitive control of the temperature on the surface of the web of paper. Furthermore, transfer of heat to the web of paper should be optimized.

In addition, the invention provides an effective method for zone-wise control of the temperature in a web of paper traveling through a steam propagation space which faces the paper web wherein steam is fed substantially uniformly over the width of the web.

According to the invention, a steam blast box of the above type includes an outlet channel extending along the steam propagation space and transverse to the direction of travel of the web for admixing air in the steam order to control the temperature. This enables particularly sensitive, zone-wise control of the temperature on the surface of the web of paper because by admixing air, an insulating layer of air is produced in front of the surface of the roll. As a result, even when there is a great excess of steam in the steam propagation space, a rapidly responding, sensitive local control or reduction of the transfer of heat to the surface of the paper is assured. Furthermore, the machine can operate with a large excess of steam so that saturated steam can spread out in the steam propagation space and thus provide optimal heating of the paper web, if no air is admixed, or the operation can remove admixed air.

In a preferred further development of the invention, the air delivery channel for delivering air to the web upstream of the steam propagation space is divided into a plurality of zones across the web, which can be individually controlled.

The invention produces a transfer of heat to the paper web which can be controlled zone-wise, in sensitive manner, over the width of the roll. Optimal adaptation of the transfer of heat is obtained upon changes in the operating parameters. If a larger or smaller amount of air is admixed zone-wise, then due to the insulating action of the layers of air which contact the surface of the roll in the direction of rotation of the roll, steam is prevented from spreading out in the steam propagation space on those regions which are to be less strongly heated. Improved zone-wise control of the heat transfer onto the surface of the web of paper is made possible. This avoids influencing of each zone by adjacent zones which are to be controlled in a different manner.

In another embodiment of the invention, separate conduits connect the zones across the web to the air feed. Control valves are associated with the conduits outside the steam blast box, in order to regulate the amount of air. This provides optimal control of the heat transfer in the individual zones. At the same time, simple maintenance and mounting are assured due to the control valves being arranged outside the steam blast box.

In a further development of the invention, a suction channel extends along the outlet side of the steam propagation space. This improves the heat transfer and the adjustability of the individual zones, since air added at the inlet side of the steam propagation space is drawn off again at the outlet side of the steam propagation space.

As an additional feature of this embodiment, the suction channel is divided into a plurality of separately controllable zones across the width of the web. If the zones of the suction channel are controlled as a function of the amount of air added in the individual zones at the inlet side, optimal adjustability and improved transfer of heat to the surface of the web of paper are enabled.

As a preferred further development for this purpose, the zones can be connected with separate conduits for leading off air. Control valves arranged outside the steam blast box are associated with those conduits for regulating the amount of air. This enables simplified mounting and maintenance of the individual control valves, since improved accessibility outside the steam blast box is assured.

In accordance with another feature of the invention, a suction channel is arranged in front of the air channel into the steam propagation space. This additionally supports the action of the following outlet channel to facilitate a fine control of the heat transfer to the web of paper over the individual zones.

In another advantageous development of the invention, seals seal the steam propagation space from the roll at the inlet side of the steam propagation space, at the outlet side of that space, and at the end sides of the steam propagation space. This improves the transfer of heat to the web of paper. Because the steam propagation space is substantially sealed off from the outside, heat losses due to steam escaping at the edges are avoided.

In a preferred embodiment of the invention, for this purpose, a constriction can be provided at the inlet side transverse to the direction of travel of the web. To do this, a wall surface of the steam blast box protrudes here to form a narrow slot with respect to the roll. This enables contactless sealing of the steam propagation space in a simple manner.

In another preferred embodiment, a plurality of nozzles for feeding of steam is provided following the constriction in the direction of the travel of the web. These nozzles are preferably shaped and arranged to produce a steam curtain which skims boundary layers of air off from the roll and transports the air, together with excess steam to the suction channel at the inlet side. This enables a particularly good transfer of heat to the paper web.

As an additional further development of the invention, a scraper or sealing ledge is provided between the steam box and the roll on the outlet side. Thus, effective sealing at the outlet side of the steam propagation space can be obtained. The scraper or sealing ledge is preferably arranged to seal against a second backing roll which forms a nip with the web supporting roll. This placement of the sealing ledge also permits heating of the backing roll. The further that the scraper or sealing ledge is arranged outward from the slot formed between the main roll and the backing roll, the greater is the additional transfer of heat to the backing roll.

In another development of the invention, side surfaces protrude toward the roll and/or backing roll to seal the steam propagation space off from the roll and/or backing roll. This makes possible contactless sealing of the steam propagation space at the side surfaces in simple manner.

With respect to the method for zone-wise control of the temperature of a traveling paper web, the invention permits the web of to paper be cooled zone-wise by feeding air on the inlet side of the steam propagation space.

In the invention, local, easy, zone-wise control of the temperature of the traveling web of paper is made possible, since a zone-wise admixing of air can be easily obtained by use of corresponding valves. On the other hand, a zone-wise control of the feeding of the steam, which can be only done with difficulty, is not necessary.

Therefore, simple zone-wise control of the temperature of the traveling web of paper is enabled. Since the temperature control is effected by cooling by feeding of air, insulating layers of air in front of the surface of the web of paper are substantially avoided. This makes sensitive zone-wise control of the temperature possible.

In an advantageous further development of the method of the invention, gas, i.e. air or an air/steam mixture, is drawn off closely upstream of the nip of two rolls which forms the outlet side of the steam propagation space. This supports the zone-wise temperature control of the traveling web of paper and makes an even more sensitive zone-wise control of the temperature possible. Either the gas is drawn off uniformly over the width of the steam propagation space or else drawing off the gas can be controlled zone-wise, similar to the feeding of the air. The latter embodiment achieves a further improved, zone-wise separated, sensitive control of the temperature.

Other objects and features of the invention will become evident from the following description of a preferred embodiment, read with reference to the drawings.

DETAILED DESCRIPTION OF EMBODIMENTS OF THE INVENTION

Figure 1:
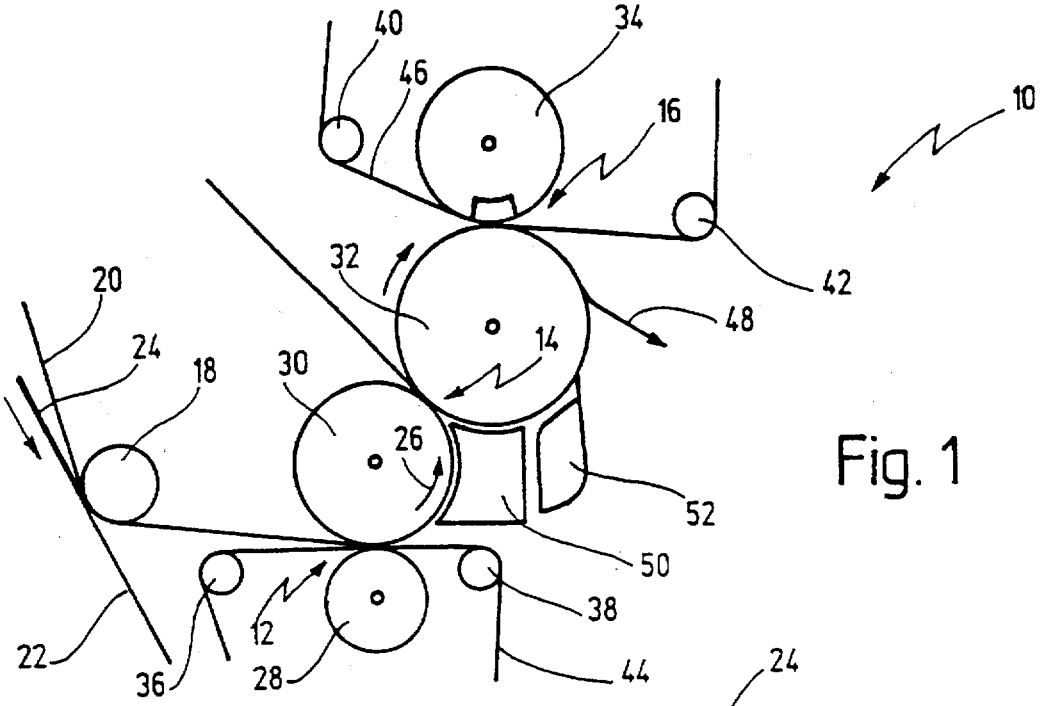
FIG. 1 schematically shows a paper machine press section having three press nips and including a suction box according to the invention.

FIG. 1 diagrammatically shows a press section 10 of a paper machine. This is a so-called three nip press, with a total of three press nips, including a first press nip 12, a second press nip 14 and a third press nip 16. A wet paper web 24 passes through the nips in succession in the direction of the arrow 26.

The paper web 24 is drawn from a fabric belt 22 onto the underside of a press belt 20 by a suction take-up roll 18. The felt 20 is guided around a roll 30, first passing through a first press nip 12 between the roll 30 and a backing roll 28, and then being carried on the roll 30 through the second press nip 14 between the roll 30 and a second backing roll 32.

Further, a second felt belt 44, which is guided over guide rolls 36, 38, is conducted through the first press nip 12 on the opposite side of the paper web from the felt 20.

The third press nip 16 is formed between the roll 32 and a shoe-press roll 34, which also may include a wide pressing zone. A felt belt 46 guided by guide rolls 40, 42 passes through the press nip 16 above the paper web. After passing through the third press nip 16, the paper web leaves the backing roll 32, as indicated by arrow 48. The surface of the backing roll 32 is then cleaned by a scraper 52.

Figure 2:
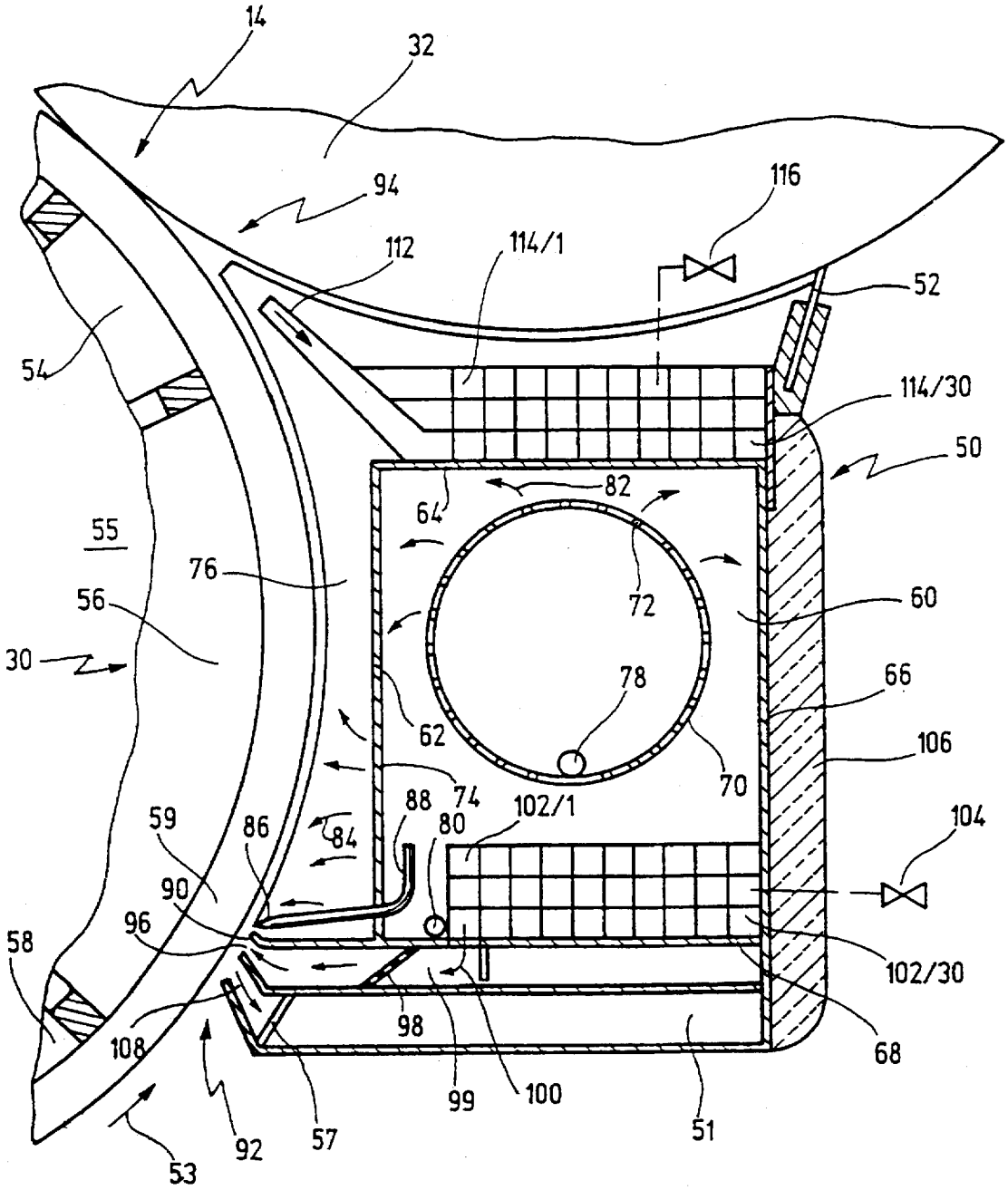
FIG. 2 is a cross section through the suction box of FIG. 1, taken in the region of the roll and the backing roll upstream of the second press nip.

In the space between the roll 30 and the backing roll 32 at the second nip 14, there is a steam blast box 50 according to the invention. FIG. 2 shows the steam blast box 50 on a larger scale, where further sections of the roll 30 and the other backing roll 32 can be noted.

The roll 30 is developed as a so-called suction roll including a stationary internal suction box 55 with a plurality of suction zones 54, 56, 58 past which a perforated roll shell 59 rotates.

The steam blast box 50 has a substantially rectangular cross section. It is arranged just upstream of the second press nip 14 that is formed between the roll 30 and the backing roll 32. The paper web conducted in the direction 53 over the roll 30 is sealed off from the roll 30 at the inlet side 92 and is sealed-off from the roll 32 at the outlet side 94.

Figure 3:
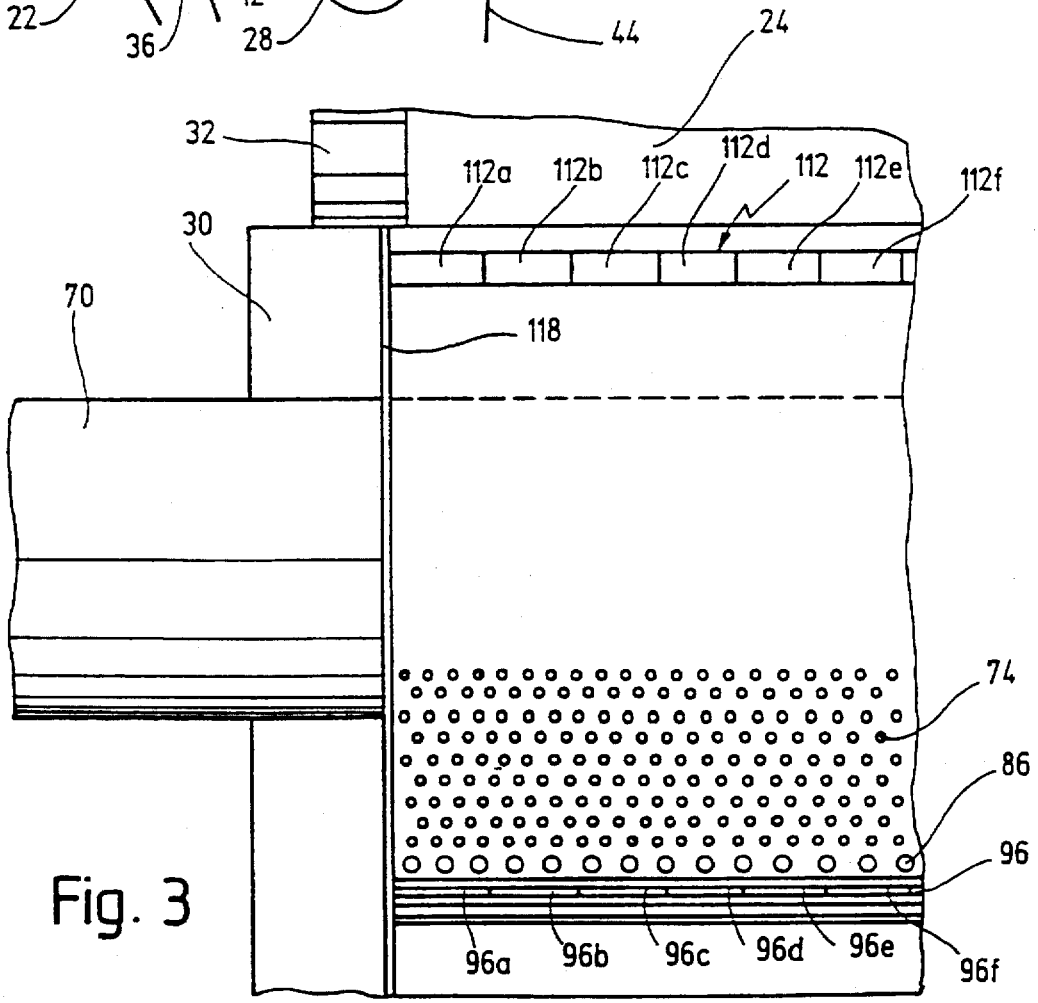
FIG. 3 is a front view of the steam blast box of FIG. 2, seen from the direction of the roll.

The steam blast box 50 includes a box shaped support having four walls 62, 64, 66, 68. It extends over the entire width of the roll 30 and is closed on its end sides by side surfaces 118 which form a narrow slot and extend between the surface of the roll 30 and the backing roll 32 (FIG. 3).

A steam blast chamber 60 is formed within the steam blast box 50. It is shut off from the outside by the four walls 62, 64, 66, 68 and the two side surfaces 118. Steam is blown through the chamber through a laterally debouching steel pipe 70 and through outlet openings 72 in its circumference. A condensate outlet 78 at the lowest point of the steam pipe 70 leads condensate away.

The front wall 62 of the steam blast chamber which faces the roll 30 is perforated in its lower region by a plurality of steam outlet openings 74 (see FIG. 3) through which steam enters a steam propagation space 76 between the roll 30 and the front wall 62. That space is limited at the bottom by a constriction 90 which is formed by the lower wall surface 68 of the steam blast box 50 which protrudes toward the roll 30 for forming a narrow slot. The steam propagation space 76 is further sealed against the backing roll 32 by a scraper 52 or sealing lip which is fastened on the outer, upper end of the steam blast chamber 60.

The steam blast chamber 60 is heat insulated from the outside in suitable manner by heat insulation 106.

Directly after the constriction 90 in the direction 53 of web travel, steam nozzles 86 are distributed over the entire width of the roll 30. They are provided with steam directly from the steam blast chamber 60 by pipes 88. The steam nozzles 86 blow steam obliquely against the roll 30 directly behind the constriction 90 practically sealing off the steam propagation space 76 at the bottom by a curtain of steam. The steam from nozzles 86 blows off any air boundary layer on the web. Steam emerging from the steam blast chamber 60 through the steam outlet openings 74 into the steam propagation space 76 can thereby establish a good transfer of heat to the surface of the paper web.

The pipes 88 for supplying the steam nozzles 86 extend somewhat upward within the steam blast chamber 60 so that their inlet openings lie above a condensate outlet 80 which extends along the lower wall 68 of the steam blast chamber 60. This prevents entrance of condensate into the pipes 88.

An air outlet channel 96 opens below the constriction 90. It also extends over the entire width of the roll 30. As seen in FIG. 3, the outlet channel 96 is divided in the longitudinal direction into individual zones 96*a*, 96*b*, 96*c*, 96*d*, 96*e*, 96*f* into which air can be blown from individual conduits via a flow-distributing grid 98 in the form of a perforated plate. Those conduits are shown diagrammatically as square conduits 102/1 to 102/30 at the lower end of the steam blast chamber 60. The air feed for the total of 30 different conduits 102/1 to 102/30 in the example shown is controlled by valves 104 each respectively for a conduit 102/1 to 102/30 and being fastened outside the steam blast box 50, approximately in the manner known from Federal Republic of Germany 44 02 278 A1.

Thus, air feed through the channel 99 in the direction of arrow 100 can be controlled separately for each of the total of 30 zones of the outlet channel.

A suction box 51 below the channel 99 debouches, in the upstream direction the outlet channel 96, in a suction slot 108 via which air can be drawn off via deflection blades 57.

There is a suction channel 112 at the upper or outlet end of the steam propagation space 76 which debouches in a suction slot shortly upstream of the second press nip 14. The suction channel 112 extends over the entire width of the steam blast box 50 between the two side surfaces 118. It is divided into a total of 30 zones, 112*a*, 112*b*, 112*c*, 112*d*, 112*e*, 112*f*, . . . Each of these zones is connected to a separate conduit 114/1 to 114/30. These conduits are diagrammatically indicated as square conduits above the steam blast chamber 60 in FIG. 2. They are connected to valves 116 outside the steam blast box 50. The valves 104 and 116 are preferably controlled such that upon an increase in the amount of air blown in over a zone of the outlet channel 96, there is a corresponding increase in the amount of air drawn off from the corresponding zone at the suction channel 112.

The steam blast box 50 operates in the following manner. Steam is blown into the steam blast chamber 60 through the steam pipe 70 via the outlet openings 72. Condensate is discharged from the steam pipe 70 via the condensate outlet 78 and from the steam blast chamber 60 via the condensate outlet 80. The steam passes through the steam outlet openings 74 on the front wall 62 in the direction indicated by arrows 84 into the steam propagation space 76.

The steam propagation space 76 is screened off from the outside by the constriction 90 at the inlet side 92. It is further sealed off by a steam curtain which is produced by the steam emerging from the steam nozzles 86.

Control over temperature or over the amount of heat transferred to the surface of the web of paper is effected separately zone-wise over the width of the steam propagation space 76. As needed, air is blown separately over the individual zones of the outlet channels 96 against the roll 30. This blown air produces a boundary layer between the steam propagation space 76 and the roll 30, and that layer impedes heat transfer to the web traveling on the roll. Thus the amount of heat transferred to the web of paper can be regulated zone-wise across the web and the roll by the amount of air blown in. The air/steam mixture is drawn off at the upper end of the steam propagation space 76 via the suction channel 112, again in zone-wise fashion, because insofar as possible, the amount of air additionally introduced in an individual longitudinal zone at the inlet side 92 is to be discharged in a corresponding manner at the outlet side 94.

The outlet slot 108 arranged just in front of the outlet channel 96 merely assures, by uniformly drawing off, the possible separate controls of the individual zones without being affected by external influences.

Since the steam propagation space 76 is limited at the upper end by the scraper 52 against the backing roll 32, heating of the backing roll 32 is also obtained. That heating increases corresponding to the distance between the location of the scraper 52 on the backing roll 32 and the second press nip 14. The arrangement of the scraper 52 can therefore be varied to control the heating of the backing roll 32. The heating of the backing roll 32 causes the paper web to still arrives sufficiently hot in the press nip 14, despite cooling by evaporation, in order for a considerable improvement in its dryness to be obtained there.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A steam blast box for applying steam to a web of paper being conducted over a roll of a paper making machine, the blast box comprising:

walls defining a steam blast chamber, the walls and the chamber extending along the length of the roll transverse to the direction of web travel on the roll, the walls of the chamber including a front wall which faces toward and is spaced away from the web on the roll, defining a steam propagation space between the front wall of the chamber and the web on the roll;

the chamber being adapted to receive steam fed to the chamber, the front wall having steam outlet openings therethrough arrayed along the length of the roll through which steam exits into the steam propagation space for contacting the web on the roll;

an air outlet channel having an outlet directed toward the roll upstream of the path of movement of the web and the roll past the steam propagation space, and the outlet channel extending along the length of the roll for delivering air to the web upstream of the steam propagation space.

2. The steam blast box of claim 1, wherein the air outlet channel includes a plurality of zones along the length of the roll and across the web; and means communicating individually controllable airflows to the zones.

3. The steam blast box of claim 1, wherein the air outlet channel includes a plurality of zones along the length of the roll and across the web; and valves communicating individually controllable airflows to the zones.

4. The steam blast box of claim 3, further comprising separate conduits to each of the zones of the air outlet channel for selective air feed to each of the zones through the respective conduits; the valves being for regulating the amount of air delivered through each of the conduits to the respective zones.

5. The steam blast box of claim 3, wherein the air outlet channel is at the upstream end of the steam propagation space;

the steam propagation space having a downstream end where the web leaves the steam propagation space;

a suction channel at the outlet end of the steam propagation space extending along the length of the roll transverse to the web.

6. The steam blast box of claim 5, wherein the suction channel is divided into a plurality of separately controllable suction zones arrayed along the length of the roll.

7. The steam blast box of claim 6, further comprising respective separate second conduits connected to each of the controllable suction zones for leading air and steam away from the steam propagation space; and valves communicating with the second conduits for controlling the amount of air withdrawn through the second conduits.

8. The steam blast box of claim 5, further comprising a second air suction channel upstream of the air outlet channel at the inlet end of the steam propagation space for drawing off air at the inlet end of the steam propagation space.

9. The steam blast box of claim 5, further comprising seals for sealing the steam propagation space against the roll, the seals being provided at the inlet end of the steam propagation space, at the outlet end of the steam propagation space and at the lateral ends of the steam propagation space toward the ends of the roll and the sides of the web.

10. The steam blast box of claim 5, wherein the steam blast box is placeable in a space generally between the roll on which the web travels and a second backing roll which meets the web on the first mentioned roll and defines a press nip, the steam blast box being placeable in a space at the inlet side of that nip;

the steam blast box including a first seal with respect to the first mentioned roll at the inlet side of the steam propagation space; and a second seal from the steam blast box toward the backing roll, the second seal being spaced on the backing roll upstream in the movement of the backing roll toward the nip formed with the first mentioned roll.

11. The steam blast box of claim 10, wherein the seals for the lateral sides of the steam propagation space comprise side surfaces protruding toward the first mentioned roll and the backing roll for sealing off the ends of the steam propagation space.

12. The steam blast box of claim 5, further comprising a plurality of steam nozzles for feeding steam toward the web, the steam nozzles being positioned generally at the inlet end of the steam propagation space in the direction of the web movement.

13. The steam blast box of claim 5, further comprising a constriction located at the inlet side of the steam propagation space, the constriction extending along the length of the roll, the constriction being defined by a wall extending from the steam blast box toward the roll for defining a narrow slot with respect to the roll through which the web passes.

14. The steam blast box of claim 13, further comprising a plurality of steam nozzles for feeding steam toward the web, the steam nozzles being positioned just after the constriction in the direction of the web movement.

15. The steam blast box of claim 13, further comprising a sealing ledge supported on the blast box and also against a second, backing roll which communicates with the first mentioned roll for defining a nip, the ledge being positioned to communicate with the backing roll at a distance upstream in the movement of the backing roll toward the nip with the first mentioned roll.

* * * * *